US007722116B2

(12) United States Patent
Takada et al.

(10) Patent No.: US 7,722,116 B2
(45) Date of Patent: May 25, 2010

(54) ACOUSTIC SEAT VIBRATORY-BONE-CONDUCTION TYPE

(75) Inventors: Naoki Takada, Tokyo (JP); Masayoshi Uehara, Tokyo (JP); Masateru Hashimoto, Tokyo (JP); Masahiro Matsuhashi, Tokyo (JP)

(73) Assignees: Clarion Co. Ltd., Tokyo (JP); Tachi-S Co. Ltd., Tokyo (JP)

( * ) Notice: Subject to any disclaimer, the term of this patent is extended or adjusted under 35 U.S.C. 154(b) by 400 days.

(21) Appl. No.: 11/721,522

(22) PCT Filed: Feb. 9, 2007

(86) PCT No.: PCT/JP2007/052327

§ 371 (c)(1),
(2), (4) Date: Jun. 12, 2007

(87) PCT Pub. No.: WO2007/099756

PCT Pub. Date: Sep. 7, 2007

(65) Prior Publication Data

US 2009/0295202 A1 Dec. 3, 2009

(30) Foreign Application Priority Data

Feb. 28, 2006 (JP) ..... 2006-052816
Feb. 28, 2006 (JP) ..... 2006-052817

(51) Int. Cl.
*A47C 7/62* (2006.01)

(52) U.S. Cl. ..... 297/217.4

(58) Field of Classification Search ..... 297/217.4, 297/217.3

See application file for complete search history.

(56) References Cited

U.S. PATENT DOCUMENTS

| | | | | |
|---|---|---|---|---|
| 5,143,055 | A * | 9/1992 | Eakin | 601/47 |
| 5,314,403 | A * | 5/1994 | Shaw | 601/148 |
| 5,387,026 | A * | 2/1995 | Matsuhashi et al. | 297/217.4 |
| 7,159,938 | B1 * | 1/2007 | Shiraishi | 297/217.4 |

FOREIGN PATENT DOCUMENTS

| | | | |
|---|---|---|---|
| JP | 59-171477 | U1 | 11/1984 |
| JP | 60-142581 | U | 9/1985 |
| JP | 62-186583 | U | 11/1987 |
| JP | 63-73799 | A | 4/1988 |
| JP | 2005-223630 | A | 8/2005 |
| JP | 2006-26044 | A | 2/2006 |

* cited by examiner

*Primary Examiner*—Milton Nelson, Jr.
(74) *Attorney, Agent, or Firm*—Browdy and Neimark, PLLC

(57) ABSTRACT

In a seat, a bass acoustic vibration transmission section and a treble acoustic vibration transmission section are arranged distinctively with respect to a seat occupant, such that those two acoustic vibration transmission sections are disposed independently of each other, thereby achieving both of the following two effects: an acoustic performance worthy of acoustic seat; and a seating comfort essentially required as a seat.

A vibration conduction unit is provided, which comprises a combination of: one bass speaker; a support plate to which that one bass speaker is secured; and a network cushion member of three-dimensional structure arranged on an anterior surface of the support plate. Such vibration conduction unit is disposed and accommodated in a cut-out region defined in a seat padding to a predetermined extent of covering an area of seat back which corresponds to a lumbar part of seat occupant, whereas on the other hand, a pair of treble speakers are respectively provided in a pair of local areas of the seat padding which correspond respectively to left-side and right-side shoulder portions of seat back, such that each of those two local areas of seat padding has an opening defined therein, wherein the opening lies anteriorly of an output side of each of the two treble speakers.

5 Claims, 3 Drawing Sheets

ACOUSTIC SEAT VIBRATORY-BONE-CONDUCTION TYPE

TECHNICAL FIELD

The present invention relates to an acoustic structure of automotive seat having a seat back in which speaker(s) is/are provided. In particular, the invention is directed to an acoustically constructed seat with vibratory system for causing bone conduction (hereinafter, an acoustic seat of vibratory-bone-conduction type) wherein a vibration generated from a bass speaker is imparted to a bone of a seat occupant sitting on the seat, to thereby transmit the vibration as a low-pitched sound to a brain of the seat occupant.

For example, there is known a so-called bone conduction system that has been used in seats and other items, according to which, a vibratory system, such as speaker or vibrational transducer, is provided in the seat and other item, so that a vibration generated from that vibratory system may be imparted to a person and transmitted through bone in his or her body, as a sound, to his or her brain. Such vibratory sound transmission via human's sensory organs, caused by the bone conduction system, (a sort of bodily sensible sound system) provides a remarkable effect in terms of: making a listener feel euphoria; placing the listener in a trancelike or exalted state; making the listener feel a sense of realism, making the listener feel a peace in mind; and so forth. Further, this particular vibratory sound system can stimulate emotional or sentimental feeling as well as instinctive sense of human, and therefore is not limited to enjoying music, but also finds practical use in relaxations and music therapy and the like.

In general, a seat is provided with a padding therein as a cushion material, and such seat padding is normally formed from a foam material which includes urethane foam for example. This sort of foam material is of an insufficient air permeability and therefore does not permit sufficient transmission of sounds. And also, the elastic property of the foam material results in absorbing a vibration imparted thereto, which raises the problem of an insufficient conduction or transmission of vibration through the foam material.

An example of solution to those problems is found in the Japanese Laid-Open Patent Publication No. 2005-223630 which teaches a resin material of spiral structure wherein a continuous hollow fiber formed from a thermoplastic resin material is looped or curved randomly, with a plurality of points thereof being contacted and entangled with one another, into a lump of three-dimensionally reticulated fiber, and discloses use of such network cushion member in the foregoing seat with built-in bone conduction system, as a cushion member, in place of the foam material.

The network cushion member (or a resin material of spiral structure) disclosed in the foregoing publication is of a three-dimensional structure with a predetermined great number of spaces defined therein at a high degree of density, and therefore, a high air permeability is provided in that material in comparison with the foam material including urethane foam. Further, the network cushion member is a hard material that can hardly absorb vibration imparted thereto, which advantageously permits for a smooth transmission of vibration therethrough. But, while having such good sound and vibration conductivity, this kind of network cushion member is of a less resilient and less cushiony property, and for that reason, when it comes to attaching a whole of such cushion member to an entire working area of seat or the like, it is highly possible that a seating comfort on the seat will be degraded and may not be enjoyed satisfactorily.

Moreover, such network cushion member is relatively inexpensive and it would be difficult cost-wise to make that cushion member adaptable for versatile uses in various fields.

Additionally, the structure of this particular known network cushion member inevitably requires that both of bass speaker(s) and treble speaker(s) be disposed therewithin to provide one cushion unit, and further, an entirety of such cushion unit be covered with a trim cover assembly. Consequently, it is more likely than not that most of low-pitched and high-pitched sounds emitted from the respective bass and treble speakers will be caught and absorbed in the inside of the trim cover assembly. Otherwise stated, such known cushion structure will inevitably decrease conduction of sound therethrough, which therefore will possibly result in deterioration of acoustic function of a seat to which the network cushion material is applied.

Cited Patent Literature 1: the Japanese Laid-Open Patent Publication No. 2005-223630

DISCLOSURE OF THE INVENTION

Problem to be Solved by the Invention

The problem to be solved by the present invention resides in that the above-stated prior art is not readily adaptable for use as a seat which attains both of the following two aspects: an acoustic performance worthy of acoustic seat; and a seating comfort essentially required as a seat.

Means for Solving the Problem

An acoustic seat of vibrator-bone-conduction type in accordance with the present invention, as claimed in claim 1, is characterized as a most indispensable main aspect in that a vibration conduction unit is provided, which comprises a combination of: one bass speaker; a support plate to which that one bass speaker is secured, with one side thereof projecting posteriorly of the support plate, wherein the support plate is resiliently suspended and supported by means of a predetermined spring element with respect to a seat back frame; and a network cushion member arranged anteriorly of the support plate in such a manner as to allow the network cushion member itself to be disposed at a point anteriorly of the afore-said one bass speaker, the network cushion member being of a three-dimensional structure wherein a continuous hollow fiber formed from a thermoplastic resin material is looped or curved randomly, with a plurality of points thereof being contacted and entangled with one another, into a lump of three-dimensionally reticulated fiber, and that such vibration conduction unit is disposed and accommodated in a cut-out region defined in a seat padding to a predetermined extent of covering an area of seat back which corresponds to a lumbar part of seat occupant, whereas on the other hand, a pair of treble speakers are respectively provided in a pair of local areas of the seat padding which correspond respectively to left-side and right-side shoulder portions of seat back, such that each of those two local areas of seat padding has an opening defined therein, wherein the opening lies anteriorly of an output side of each of the two treble speakers.

An acoustic seat of vibrator-bone-conduction type in accordance with the present invention, as claimed in claim 2, is characterized as a most indispensable main aspect in that each of the afore-said pair of treble speakers is arranged in each of the afore-said pair of local areas of seat padding which correspond respectively to the left-side and right-side shoulder portions of the seat back, in such a manner that the output side thereof is at least exposed in a direction to a side where a working backrest surface of the seat back lies.

An acoustic seat of vibrator-bone-conduction type in accordance with the present invention, as claimed in claim 3, is characterized as a most indispensable main aspect in that each of the afore-said pair of treble speakers is disposed and accommodated in a recession of predetermined configuration formed in each of the afore-said pair of local areas of seat padding which correspond respectively to the left-side and right-side shoulder portions of seat back, such that the opening associated with the foregoing each of two local areas of seat padding lies anteriorly of the output side of each of the two treble speakers, and that a protection wall element is provided peripherally of the output side of each of the two treble speakers so as to project towards a side anteriorly of that particular output side, wherein the protection wall element is adapted to prevent entry of the seat padding into a point anteriorly of the output side of each of the two treble speakers from a periphery of that particular output side.

An acoustic seat of vibratory-bone-conduction type in accordance with the present invention, as claimed in claim 4, is characterized as a most indispensable main aspect in that the afore-said protection wall element comprises a rubber ring element which is resiliently deformable.

An acoustic seat of vibratory-bone-conduction type in accordance with the present invention, as claimed in claim 5, is characterized as a most indispensable main aspect in that the slab material is disposed anteriorly of said network cushion member.

According to advantageous effects attainable by the acoustic seat of vibratory-bone-conduction type described in claim 1, there are distinctively defined a bass acoustic vibration transmission section and a treble acoustic vibration transmission section in the seat back with respect to a seat occupant, and the network cushion member is provided in the seat back to a predetermined extent of covering the area of the seat back corresponding to a lumbar part of the seat occupant, thereby allowing for full transmission of low-pitched sounds to the seat occupant, without any loss thereof, and also preventing deterioration of cushioning effect of the seat. Further, two treble speakers are provided in the respective left-side and right-side shoulder portions, thereby allowing high-pitched sounds therefrom to be transmitted to the seat occupant without any loss thereof. Hence, it is possible to achieve both of the following two effects: an acoustic performance worthy of acoustic seat which effectively transmits a sound source such as music to the seat occupant; and a seating comfort essentially required as a seat for providing an optimum seating touch to the seat occupant.

Further, according to the acoustic seat of claim 1, the network cushion member of relatively high price is simply disposed partway in the local region of the seat back which substantially corresponds to a lumbar part of the seat occupant, which therefore leads to a substantive reduction of a whole costs involved.

Furthermore, such network cushion member disposed in that local seat back region corresponding to the seat occupant's lumbar part is resiliently supported by spring element(s), so that the network cushion member is movable gently backwards so as to give a deep support touch to the seat occupant' back, and therefore, the seat occupant does not feel an unpleasant contact of his or her back with a base of seat back. This aspect also in effect achieves a highly improved seating comfort of the seat.

According to advantageous effects attainable by the acoustic seat of vibratory-bone-conduction type described in claim 2, each treble speaker is arranged in a local area of seat padding corresponding to one shoulder portion of seat back, with the output side thereof being at least exposed to the side where the working backrest surface of seat back lies, thereby positively preventing loss of transmission of high-pitched sounds to the seat occupant, while highly improving acoustic performance worthy of acoustic seat. Also, the exposure of treble speaker in the shoulder portion of seat back effectively improves the aesthetic appearance of seat back or seat, thus providing a great prospect for increased commercial value of the seat.

According to advantageous effects attainable by the acoustic seat of vibratory-bone-conduction type described in claim 3, there are distinctively defined a bass acoustic vibration transmission section and a treble acoustic vibration transmission section in the seat back with respect to a seat occupant, and the network cushion member is provided in the seat back to a predetermined extend of covering the area of the seat back corresponding to a lumbar part of the seat occupant, thereby allowing for full transmission of low-pitched sounds to the seat occupant, without any loss thereof, and also preventing deterioration of cushioning effect of the seat. Further, two treble speakers are provided in the respective left-side and right-side shoulder portions, thereby allowing high-pitched sounds therefrom to be transmitted to the seat occupant without any loss thereof. Hence, it is possible to achieve both of the following two effects: an acoustic performance worthy of acoustic seat which effectively transmits a sound source such as music to the seat occupant; and a seating comfort essentially required as a seat for providing an optimum seating touch to the seat occupant.

Further, according to the acoustic seat of claim 3, the provision of protection wall element around the periphery of output side of tremble speaker prevents entry of the seat padding into a point anteriorly of that particular output side, thereby allowing for a more positive transmission of high-pitched sounds from the speaker to the seat occupant.

Furthermore, according to the claim 3, since the treble speaker is disposed and accommodated in the recession of seat padding, it is possible to install the treble speaker within the seat back, without impairing the aesthetic appearance and quality of seat back.

Additionally, according to the aspect of the present invention as defined in claim 4, the protection wall element is embodied by a rubber ring element, thereby allowing installation of that particular rubber ring element, in the seat back, without giving any unpleasant or objectionable touch to a back of seat occupant.

Still additionally, according to the aspect of the present invention as defined in claim 5, since the slab material is disposed on the anterior surface of the network cushion member associated with the vibration conduction unit, it is possible to easily achieve a highly improved cushioning effect of the seat back.

DESCRIPTION OF THE REFERENCE NUMERAL

10 . . . acoustic seat of vibratory-bone-conduction type, 12 . . . seat back, 14 . . . bass speaker, 16 . . . network cushion member, 18 . . . vibration conduction unit, 20 . . . treble speaker, 30 . . . support plate, 42 . . . protection wall element

BEST MODE FOR CARRYING OUT THE INVENTION

According to the present invention, in brief, a bass acoustic vibration transmission section and a treble acoustic vibration transmission section are arranged distinctively in a seat, such that the two acoustic vibration transmission sections are disposed independently of each other, thereby achieving both of the following two aspects: an acoustic performance worthy of acoustic seat; and a seating comfort essentially required as a seat.

EXEMPLARY EMBODIMENT

Figure 1:
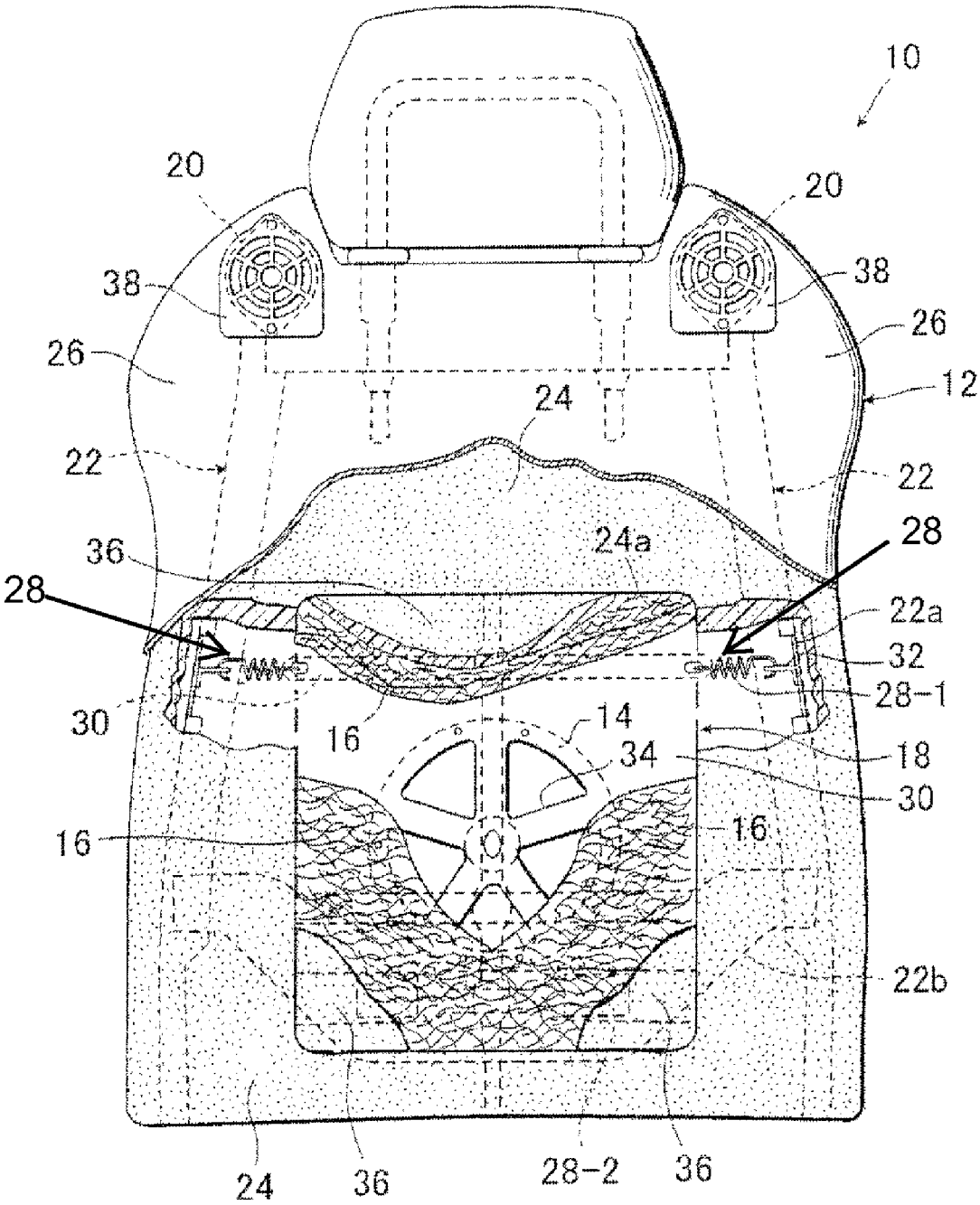
FIG. 1: A partly broken front view showing a seat back of an acoustic seat of vibratory-bone-conduction type in accordance with the present invention.
Figure 2:
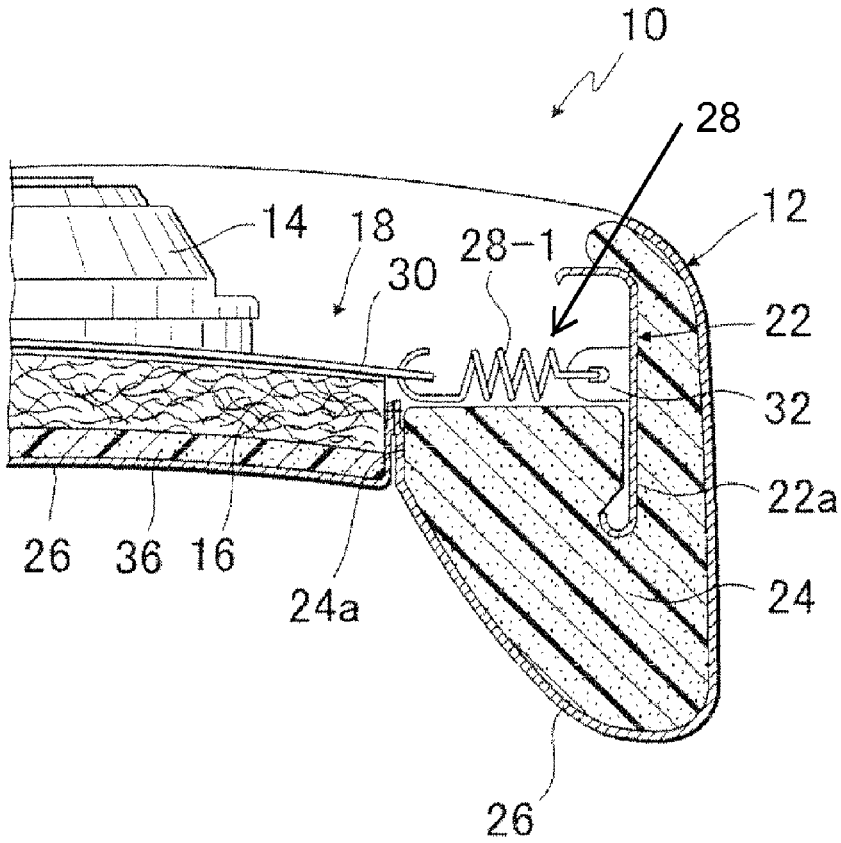
FIG. 2: A fragmentary sectional view showing a local portion of the seat back of the acoustic seat of vibratory-bone-conduction type, which corresponds to a lumbar part of a seat occupant.
Figure 3:
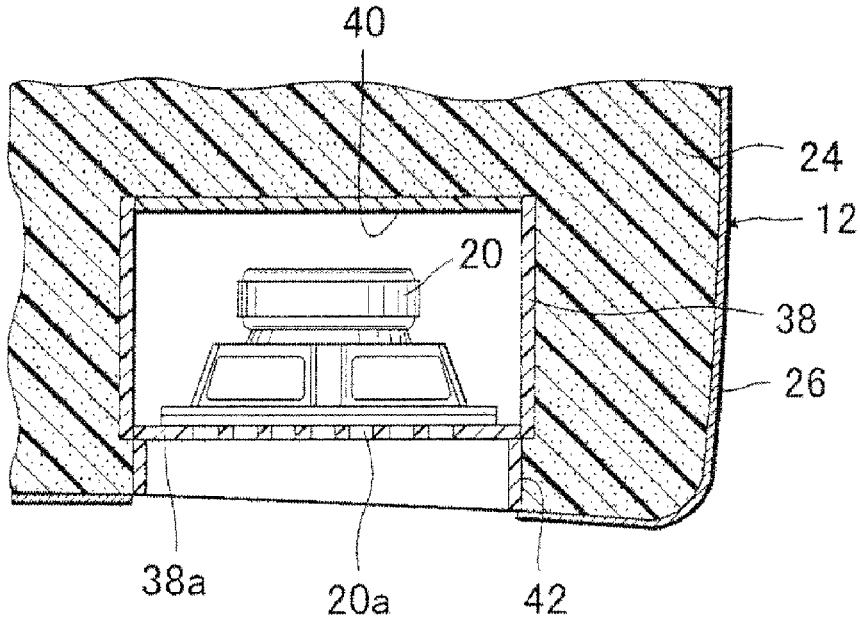
FIG. 3: A partly broken schematic cross-sectional view showing a shoulder portion of the seat back of the acoustic seat of vibratory-bone-conduction type.

FIGS. 1 and 2 are respectively a partly broken front view and a fragmentary sectional view, each of which shows a seat back 12 of an acoustic seat of vibratory-bone-conduction type (10)) in accordance with the present invention. As illustrated, according to the seat of the present invention, there is provided a vibration conduction unit 18 comprising one bass speaker 14 and a network cushion member 16, and such vibration conduction unit 18 is resiliently supported at a lower backrest region of the seat back which substantially corresponds to a lumbar part of a seat occupant. And also, a pair of treble speakers are provided in the respective right-side and left-side upper backrest regions of the seat back which substantially correspond to a shoulder part of the seat occupant.

Hereinafter, the present invention will be described in the case where the acoustic seat of vibratory-bone-conduction type is a vehicle seat including automotive seat and the like, by way of example. It is to be understood that describing a basic structure of such vehicle seat as applied substantially to the acoustic seat of vibratory-bone-conduction type will suffice to specifically define the structure and functions of that particular acoustic seat within the scopes of the present invention.

As shown in FIGS. 1 and 2, basic formation of the seat back 12 of the acoustic seat of vibratory-bone-conduction type is such that, likewise as in the prior art, a seat back frame 22 is formed in a substantially rectangular shape as a basic framework of the seat back, and a seat padding 24, which is a foam element including urethane foam and the like, is disposed anteriorly of the seat back frame together with a resilient support element including a plurality of S-springs or sinuous springs (not shown) and the like, wherein the plurality of sinuous springs may for example be extended between the right and left lateral sides of the seat back frame 22, and that, finally, those seat back frame, seat padding and resilient support element are entirely covered with a trim cover assembly 26, whereupon is formed the illustrative seat back 12.

Based on the foregoing basic structure, in accordance with the present invention, a cut-out region 24*a* of substantially rectangular shape may for example be formed in a predetermined dimensions in a particular local area of the seat padding 24 (i.e. the network cushion member) provided in the seat back, wherein such particular local area of seat padding 24 substantially corresponds to a lumbar part of seat occupant on the seat. And also, in accordance with the invention, the aforementioned vibration conduction unit 18 is disposed and accommodated in the cut-out region 24*a*.

The cut-out region 24*a* may for example be a through-hole so formed to penetrate the seat padding as shown. On the other hand, the vibration conduction unit 18 may be fixed to a support plate 30 for example, and the support plate 30 be resiliently supported in the cut-out region 24*a* by spring elements 28 or the like in a suspended way, such that the vibration conduction unit 18 itself is resiliently movable at least in the backward direction to thereof.

As an exemplary mode of the afore-said spring elements 28, a combination of extension coil springs 28-1 and leaf springs 28-2 of compression spring type may preferably be used. As illustrated, one of the extension coil springs 28-1 is stretched and extended between an upper portion of the support plate 30 and a securing lug 32 fixed to a right-side frame member 22*a* of the seat back frame 22, whereas another of the extension coil springs 28-1 is stretched and extended between the upper portion of support plate 30 and another securing lug 32 fixed to a left-side frame member 22*a* of the seat back frame 22. The leaf springs 28-2 are disposed between a backward side of a lower portion of the support plate and a lower frame member 22*b* of the seat back frame, wherein the lower frame member 22*b* is recessed toward a side posteriorly of the seat back frame.

In the present embodiment, the foregoing lower portion of the support plate 30 is resiliently supported by the leaf spring 28-2 of compression spring type. In this connection, the spring elements 28 per se, including the leaf spring 28-2, are provided to resiliently act on the support plate 30 in response to a pressure applied from the lumbar part of seat occupant, such that, upon the support plate 30 receiving such pressure, the springs elements 28 are resiliently deformed to allow movement of the support plate 30 toward a side posteriorly of that particular support plate 30. Hence, insofar as such action is attainable, the spring elements 28 may be embodied in any desired manner, without being limited to the leaf spring 28-2. For example, instead of the leaf spring 28-2, additional coil springs 28-1 may also be used to resiliently support the lower portion of the support plate 30, in which case, one of the additional extension coil springs 28-1 be stretched and extended between the lower portion of the support plate and the right-side frame member 22*a*, whereas another of the additional extension coil springs 28-1 be stretched and extended between the lower portion of the support plate and the left-side frame member 22*a*.

As stated above, the leaf spring 28-2 is used as one exemplary mode of the spring elements adapted for resiliently supporting the lower portion of the support plate. Generally stated, such particular spring elements are of the type that can be resiliently compressed so as to be deformable in the backward direction thereof. Thus, insofar as such action is attainable, the spring element of this kind may be embodied in any desired manner, without being limited to the leaf spring. For example, such kind of spring element may be a solid spring unit formed by bending a sinuous spring or S-spring in a certain three-dimensional fashion.

Accordingly, in the present embodiment, a combination of the extension coil springs 28-1 and the compression leaf springs 28-2 is provided as a preferred mode of the spring element, such that the former 28-1 and the latter 28-2 are respectively connected with the upper and lower portions of the support plate. It is therefore appreciated that the provision of extension coil springs 28-1 insures to allow the upper portion of the support plate to be movable backwardly and forwardly in a substantive stroke, and at the same time, the provision of leaf springs 28-2 insures to prevent the support plate from being dislocated downwardly due to the weight of that particular support plate.

The afore-said support plate 30 may be a resin panel made of a synthetic resin material, such as ABS or PP., for instance. This particular support plate 30 (or the resin panel) may be formed three-dimensionally by gently waving and curving its entire body in lengthwise and crosswise directions so as to provide an appropriate three-dimensional configuration to receive a lumbar part of human body in conformity with the shape of lumbar spine.

On a backward surface of the support plate 30, is fixedly mounted the previously mentioned one single bass speaker 14.

The bass speaker 14 may be an ordinary woofer available on the market, for example, which may be fixedly fastened by screws or the like to a posterior surface of the support plate 30 in such a manner that a rear side of the bass speaker projects in a direction posteriorly of the support plate, as illustrated.

In this regard, as shown in FIG. 1, a through-hole 34 is formed in the support plate 30 in a shape substantially identical to a shape of the bass speaker 14 (or the woofer), so as not to prevent emission of low-pitched sounds from that speaker.

As shown in FIGS. 1 and 2, the network cushion member 16 is mounted on an anterior surface of the support plate 30 which is opposite to the posterior surface of the same on which the bass speaker 14 is mounted as stated above.

The network cushion member 16 is a resin material of spiral structure wherein a continuous hollow fiber formed from a thermoplastic resin material is looped or curved randomly, with a plurality of points thereof being contacted and entangled with one another, into a lump of three-dimensionally reticulated fiber. This particular network cushion member 16 is formed substantially flat and in a shape substantially equal to a shape of the support plate 30, and has a predetermined thickness, such as a thickness of approx. 3 to 4 cm.

The network cushion member 16 may be fixedly and integrally connected with the anterior surface of the support plate 30 by means of adhesive agent for example.

A preferred exemplary mode of the network cushion member 16 may be the resin material of spiral structure disclosed in the Japanese Laid-Open Patent Publication No. 2005-223630.

Further, in the present embodiment, an urethane foam slab material 36 of substantially planar shape, with continuous cellular bores formed therein, is disposed on an anterior surface of the afore-said network cushion member 16. This urethane foam slab material 36 is formed substantially flat and in a shape substantially equal to a shape of the network cushion member 16.

As shown in FIG. 1, in accordance with the acoustic seat of vibratory-bone-conduction type 10 of the present invention, a pair of treble speakers 20 are provided in the left-side and right-side shoulder regions of the seat back 12, respectively.

An example of the treble speakers 20 for use in the seat includes an ordinary tweeter available on market, a full-range speaker, or other suitable speaker. Such treble speaker 20 may be accommodated in a resin casing 38 to provide a treble sneaker unit, for instance, which may be fixedly connected with the seat cushion frame 22 or other frame elements in the seat back 12, such that an output side of the speaker is exposed outwardly from the working backrest surface of seat back 12 on which a back of seat occupant is to rest.

In this respect, in accordance with the present invention, it is noted that a portion of the seat padding 24 of the seat back, in which each treble speaker 20 is disposed, has an opening defined anteriorly of the output plane of that particular speaker 20, wherein such opening is formed by cutting out a localized area of the anterior side of the seat padding 24 in correspondence with the output side of speaker, and that, as seen in FIGS. 3 to 6, a protection wall element 42 is provided to and along a periphery of the output side of treble speaker 20 so as to project in a direction anteriorly of that particular output side, the protection wall element 42 being adapted to prevent entry of a part of the seat padding over the periphery of output side of treble speaker 20 into a point anteriorly of that particular output side of treble speaker 20.

An exemplary mode of the foregoing protection wall element 42 may be a resin protection ring as illustrated. This resin protection ring is shown as being provided to an anterior shielding wall 38*a* of the resin casing 38 in such a manner as to erect thereon.

From the above-described structure of acoustic seat of vibratory-bone-conduction type, it is to be appreciated that the bass speaker 14, which is one element of the vibration conduction unit provided in the seat back 12 at a point corresponding to a lumbar part of seat occupant, works as a source of vibration for generating a vibration from low-pitched sounds emitted form the speaker and transmitting such vibration to a lumbar spine of the seat occupant, which means that the vibration is imparted as a bass to the bone of seat occupant.

Further, in accordance with the present invention, the network cushion member 16, which permits most of the vibration to be transmitted therethrough without substantive loss thereof, is disposed on the side anteriorly of the bass speaker 14, and therefore, it is possible with such arrangement to effectively transmit the vibration to the lumbar spine (or bone) of seat occupant, with a high efficiency.

Furthermore, in accordance with the acoustic seat of vibratory-bone-conduction type, the network cushion member 16 of a relatively hard property is simply disposed in a predetermined region of the seat back 12 corresponding to the lumbar part of seat occupant. Therefore, in the present invention, it is possible to easily and assuredly provide an optimum seat structure that permits smooth transmission of low-pitched sound vibration to the lumbar part of seat occupant sitting on the seat, while maintaining original cushioning function of the seat back on the whole.

In addition thereto, in the present invention, a pair of treble speakers 20 are provided in the respective left-side and right-side shoulder regions of the seat back 12, with the output sides respectively thereof exposed outwardly from the seat back. This means that no foam material of sound absorbing property, such as the seat padding 24, lies in front of the output side of each of the treble speakers 20, thereby insuring to allow a high efficient output of tremble sounds from the speakers, without any acoustic means, and thus allow the tremble sounds to directly reach ears of a seat occupant on the seat. Moreover, the treble speakers, provided in the shoulder regions of seat back 12, are distant from a point on which the seat occupant's back is to rest and therefore not objectionable to the seat occupant, thereby completely solving such a problem that the exposure of treble speakers 20 will result in deteriorating the cushioning effect of the seat back.

From the descriptions above, in accordance with the acoustic seat of vibratory-bone-conduction type in the present invention, it is to be appreciated that a bass acoustic vibration transmission section and a treble acoustic vibration transmission section are arranged distinctively in the seat back, such that the two acoustic vibration transmission sections are disposed independently of each other, thereby simultaneously achieving both of the following two aspects: an acoustic performance worthy of acoustic seat for transmitting a sound source, such as music, to the seat occupant; and a seating comfort essentially required as a seat.

Further, in the present invention, the relatively inexpensive network cushion member 16 can be simply disposed partway in a predetermined region of the seat back 12 corresponding to the lumbar part of seat occupant, which enables substantive reduction of total costs involved.

Still further, in the present invention, the vibration conduction unit 18 disposed in the predetermined region of seat back 12 corresponding to the lumbar part of seat occupant is resiliently supported by the spring elements 28-1 and 28-2, and therefore, upon receiving a pressure from a seat occupant who rests his or her back on the seat back, the vibration conduction unit 18 is moved gently backwards so as to give a deep support touch to the seat occupant' back. Hence, the seat occupant does not feel an unpleasant contact of his or her back with a base of seat back. This aspect also in effect achieves a highly improved seating comfort of the seat.

In the present embodiment, as stated above, the slab material 36 is disposed on the anterior surface of the network cushion member 16, but, such arrangement of slab material 36 is merely intended to provide an additional cushion effect to the portion of seat back corresponding to the vibration conduction unit 18. Thus, the slab material 36 may be removed therefrom as desired.

Nonetheless, instead of such removal, the foregoing disposition of the slab material 36 on the anterior surface of network cushion member 16 is recommended for providing a far-increased cushiony effect, as compared with the case where the network cushion member 16 is only provided in the seat back.

In this connection, according to the present invention, the vibration conduction unit 18 is of a predetermined dimensions relative to the seat back to the extent of allowing sufficient transmission of a bass acoustic vibration therethrough, and therefore, the provision of the network cushion member 16 on a side anteriorly of the bass speaker 14 is naturally effective in limiting or reducing a thickness of the afore-said slab material 36. Accordingly, it is considered that to dispose the slab material 36 on the anterior side of the network cushion member 16 will not adversely affect transmission of acoustic vibration therethrough.

Moreover, in the present invention, the seat padding 24 has an opening defined anteriorly of the output side of each treble speaker 20, wherein such opening is formed by cutting out an anterior local region of the seat padding which corresponds to that particular treble speaker. Hence, due to such opening, any sound from the treble speakers is not absorbed by the seat padding, and a highly efficient transmission of high-pitched sounds is readily and assuredly attainable. This aspect of the invention also insures to achieve both of the following two effects: a high acoustic performance worthy of acoustic seat; and an improved seating comfort of the seat which is attained since the seat padding 24 can be used as a cushion member which does not adversely affect transmission of sound.

Additionally, in the present invention, the protection wall element 42 is provided to and along the periphery of the output side 20*a* of each treble speaker 20 so as to prevent entry of a part of the seat padding 24 over that periphery of treble speaker output side 20*a* into a point anteriorly of that particular treble speaker output side 20*a*, which may occur due to the seat padding 24 being deformed and expanded by a load applied thereto from a seat occupant. This arrangement insures to attain a highly efficient transmission of high-pitched sound through the seat padding, irrespective of how a seat occupant may rest his or her back on the seat back. Such particular aspect of the invention also achieves a high acoustic performance enough to permit use of the seat as an acoustic seat.

Figure 4:
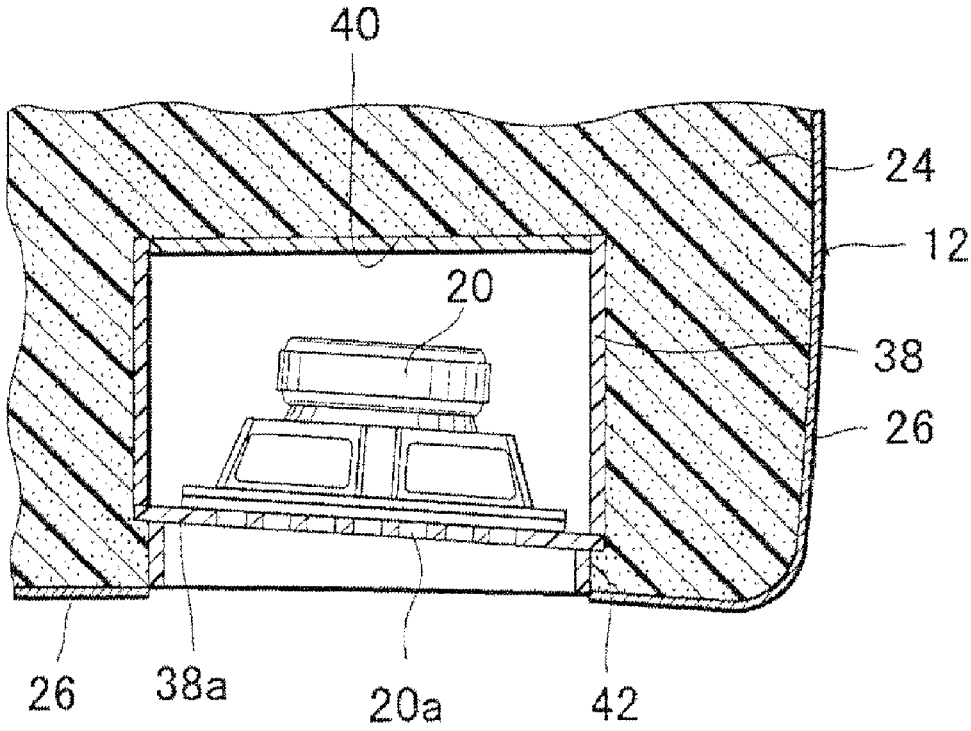
FIG. 4: A partly broken schematic cross-sectional view showing another embodiment of the shoulder portion of the seat back of the acoustic seat of vibratory-bone-conduction type.

In this context, according to the invention, the treble speaker 20 is disposed and accommodated in a recession 40 formed in the seat padding, whereupon the tremble speaker 20 itself is situated within the seat back 12, without impearling the aesthetic appearance and quality of the seat back. In this regard, by increasing and decreasing a height of the afore-said protection wall element 42, the treble speaker 20 can be adjustably positioned in forward and backward directions to and from the working backrest surface of seat back on which a seat occupant's back is to rest, or, by providing a beveled protection wall element 42 as shown in FIG. 4, the treble speaker 20 can be inclined at a desired angle relative to that working backrest surface of seat back. Thus, it is possible to arrange or re-arrange the treble speaker 20 in the inside of the seat back in a desired fashion, without impearling the outer aesthetic appearance of the seat back 12.

As far as the illustrative embodiment is concerned, the protection wall element 42 comprises a resin ringed wall that has been described previously. This is however not imitative, and for example, the protection wall element 42 may comprise vertical extensions respectively of vertical lateral walls of the aforementioned resin casing 38, wherein such vertical extensions are formed by increasing lengths of all the vertical lateral walls of resin casing 38 in forward direction.

Further, as alternative to the resin ringed wall, the protection wall element 42 may be embodied by a rubber ring element of a resiliently deformable property.

Figure 5:
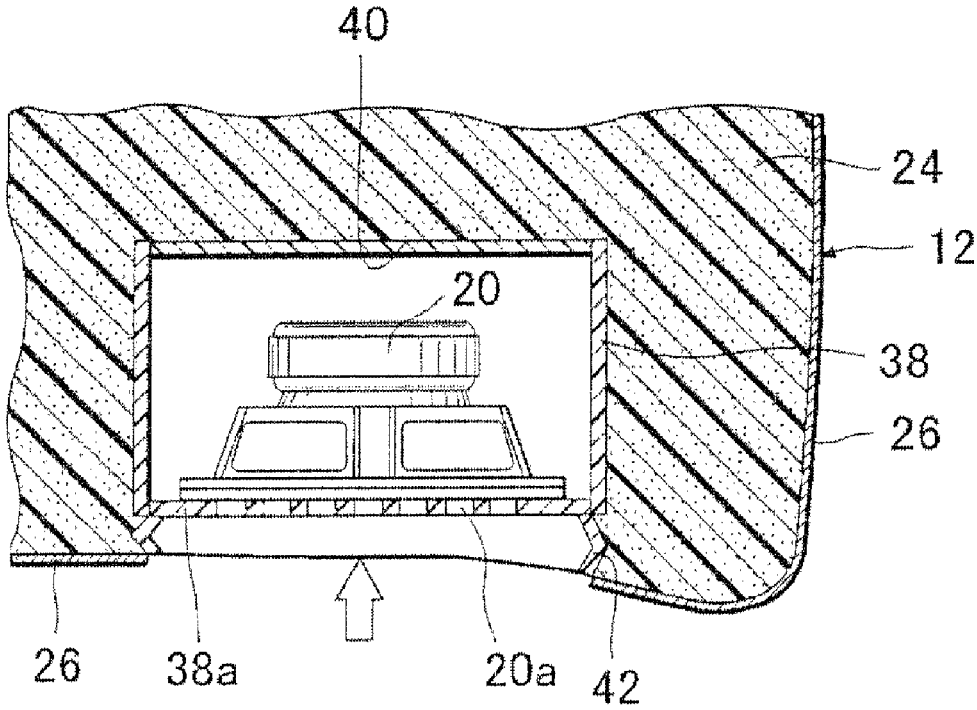
FIG. 5: A partly broken schematic cross-sectional view showing still another embodiment of the shoulder portion of the seat back of the acoustic seat of vibratory-bone-conduction type.

Reference is made to FIG. 5 wherein such rubber ringed protection wall is shown to be employed as the protection wall element 42, and it is seen therefrom that the rubber ring element is resiliently deformed in response to a load applied thereto from an occupant on the seat. Namely, with such arrangement, the seat occupant will not feel any unpleasant or objectionable touch at his or her back. Thus, this kind of rubber ring element may preferably be used to attain a further improved cushiony effect of seat back.

In the present embodiment, the treble speaker 20 is exposed outwardly at the output side thereof in the shoulder region of seat back 12, as described above. In this regard, any foam cushion member, such as the seat padding, may not be disposed anteriorly of that particular output side of tremble speaker 20, in which case, the trim cover assembly 26 may be attached to the seat back shoulder region so as to overlie a whole of the treble speaker 20. In that case, a meshed region may be defined in the very local portion of trim cover assembly 26 that faces the output side of treble speaker 20, by way of a preferred example.

However, instead of such alternative embodiment, it is preferable that, likewise as in the present embodiment described above, at least the output side of the treble speaker should be exposed in the shoulder region of the seat back 12, which will positively prevent loss of transmission of acoustic vibration from the speaker to a seat occupant, and also will attain an improved aesthetic appearance of seat which is worthy of its acoustic characteristics, hence providing a great prospect for increased commercial value of the seat.

It is noted that the embodiment that has been described above is merely intended to explain one aspect of the present invention and therefore does not limit the invention thereto, and further, anyone skilled in the art can naturally understand that any other modification, alteration and the like may be effected within the scope of technical concept claimed by the present invention.

The present invention is not limited to vehicle seats, such as automotive seats, but, the invention may also be applied to various kinds of vehicle seats including seats for train, airplane or vessel, and further applied to other kinds of seats including seats for use in theater, house or medical facilities.

The invention claimed is:

1. An acoustic seat of vibratory-bone-conduction type, comprising: a seat back having a working backrest surface on which a back of an occupant on said acoustic seat is to rest, said seat back at least having a foam member provided therein as a seat padding, such that said foam member is disposed on a side of said working backrest surface, wherein said foam member is formed from a foam material inclusive of urethane foam;

a vibration conduction unit comprising a combination of: one bass speaker;

a support plate to which said one bass speaker is secured, with one side thereof projecting posteriorly of the support plate, said support plate being resiliently suspended and supported by means of a predetermined spring element with respect to a seat back frame; and a network cushion member arranged anteriorly of said support plate in such a manner as to allow the network cushion member itself to be disposed at a point anteriorly of said one bass speaker, said network cushion member being of a three-dimensional structure, wherein a continuous hollow fiber formed from a thermoplastic resin material is looped or curved randomly, with a plurality of points thereof being contacted and entangled with one another, into a lump of three-dimensionally reticulated fiber;

said vibration conduction unit being disposed and accommodated in a cut-out region of said seat padding, wherein said cut-out region is defined in the seat padding to a predetermined extent of covering an area of said seat back which corresponds to a lumbar part of said occupant; and a pair of treble speakers respectively provided in a pair of local areas of said seat padding which correspond respectively to left-side and right-side shoulder portions of said seat back, such that each of said pair of local areas of said seat padding has an opening defined therein, wherein said opening lies anteriorly of an output side of each of said pair of treble speakers.

2. The acoustic seat of vibratory-bone-conduction type as described in claim 1, wherein each of said pair of treble speakers is arranged in each of said pair of local areas of said seat padding which correspond respectively to said left-side and right-side shoulder portions of said seat back, in such a manner that the output side thereof is at least exposed in a direction to a side where said working backrest surface of said seat back lies.

3. The acoustic seat of vibratory-bone-conduction type as described in claim 1, wherein each of said pair of treble speakers is disposed and accommodated in a recession of predetermined configuration, said recession being formed in each of said pair of local areas of said seat padding which correspond respectively to said left-side and right-side shoulder portions of said seat back, such that said opening associated with said each of said pair of local areas of said seat padding lies anteriorly of said output side of said each of said pair of treble speakers, and wherein a protection wall element is provided peripherally of said output side of said each of said pair of treble speakers so as to project towards a side anteriorly of said particular output side, said protection wall element being adapted to prevent entry of said seat padding into a point anteriorly of said output side of said each of said pair of treble speakers from a periphery of said particular output side.

4. The acoustic seat of vibratory-bone-conduction type as described in claim 3, wherein said protection wall element comprises a rubber ring element which is resiliently deformable.

5. The acoustic seat of vibratory-bone-conduction type as described in claim 1, wherein a slab material is disposed anteriorly of said network cushion member.

* * * * *